US006435691B1

(12) United States Patent
Macey et al.

(10) Patent No.: US 6,435,691 B1
(45) Date of Patent: Aug. 20, 2002

(54) LIGHTING APPARATUS FOR PORTABLE SPAS AND THE LIKE

(75) Inventors: Stephen S. Macey, Oceanside; Neil R. Bergstrom, La Mesa, both of CA (US)

(73) Assignee: Watkins Manufacturing Corporation, Vista, CA (US)

( * ) Notice: Subject to any disclaimer, the term of this patent is extended or adjusted under 35 U.S.C. 154(b) by 0 days.

(21) Appl. No.: 09/450,898

(22) Filed: Nov. 29, 1999

(51) Int. Cl.[7] ..... F21V 33/00

(52) U.S. Cl. ..... 362/101; 362/147; 362/240; 362/267; 362/246; 362/275; 362/264; 362/800

(58) Field of Search ..... 362/101, 154, 362/147, 240, 311, 363, 267, 374, 375, 235, 244, 800, 246, 364

(56) References Cited

U.S. PATENT DOCUMENTS 4,234,819 A * 11/1980 Maxey ..... 315/119
4,613,169 A * 9/1986 Engelhart ..... 285/161
5,051,875 A 9/1991 Johnson
5,207,499 A * 5/1993 Vajda et al. ..... 362/96
5,676,805 A * 10/1997 Silveri ..... 204/212
5,752,282 A * 5/1998 Silveri ..... 4/341.1
5,842,771 A 12/1998 Thrasher et al.
6,016,038 A 1/2000 Mueller

* cited by examiner

*Primary Examiner*—Stephen Husar
*Assistant Examiner*—Bertrand Zeade
(74) *Attorney, Agent, or Firm*—Price and Gess

(57) ABSTRACT

A spa lighting apparatus including a wall fitting which seats in an opening in a spa wall and threadably receives a light transmissive lens which includes respective plastic layers providing impact and chemical resistance. The lens is further designed to disperse light from a plurality of LED sources to give an appearance similar to that of a single incandescent source.

19 Claims, 4 Drawing Sheets

LIGHTING APPARATUS FOR PORTABLE SPAS AND THE LIKE

BACKGROUND OF THE INVENTION

1. Field of the Invention

The subject invention relates generally to portable spas and more particularly to improved lighting apparatus for use with such spas.

2. Description of Related Art

Conventionally, portable spas have been illuminated by high voltage incandescent lamps. Such lamps have been installed in a sidewall area of the spa which is relatively unsupported and weak. Typically this sidewall area lies adjacent the spa equipment compartment, and a large opening is created in the sidewall to receive the incandescent light. A light fixture including a polycarbonate lens and mounting ring is then mounted on "prongs" extending from the spa surface and clamped into place using considerable amounts of adhesive to create a seal between the mounting ring and the spa surface.

This prior art spa lighting approach has a number of drawbacks, for example, in that the location of the light fixture is restricted and in that loading stresses around the large opening in the spa sidewall are transferred to the polycarbonate lens, which is then subject to frequent cracking. Moreover, the incandescent lamps conventionally used have a relatively limited life. Lens or lamp failures typically require costly dealer servicing of the spa unit.

SUMMARY OF THE INVENTION

According to the invention, a spa lighting apparatus is provided which employs a plurality of light emitting diodes (LED's) as the light source. The LED's are positioned within a fitting which reinforces the opening in the spa and prevents spa wall forces from cracking an associated lens component. As another aspect of the invention, a special lens component is provided which provides chemical resistance and also disperses the light from multiple LED light sources such that the light appears to come from one light source, as opposed to a number of sources. The subject lighting apparatus may be mounted in areas of the spa remote from the equipment compartment and provides much longer service life, as well as lower power consumption.

BRIEF DESCRIPTION OF THE DRAWINGS

The just summarized invention will now be described in detail in conjunction with the drawings of which.

DETAILED DESCRIPTION OF THE PREFERRED EMBODIMENTS

Figure 1:
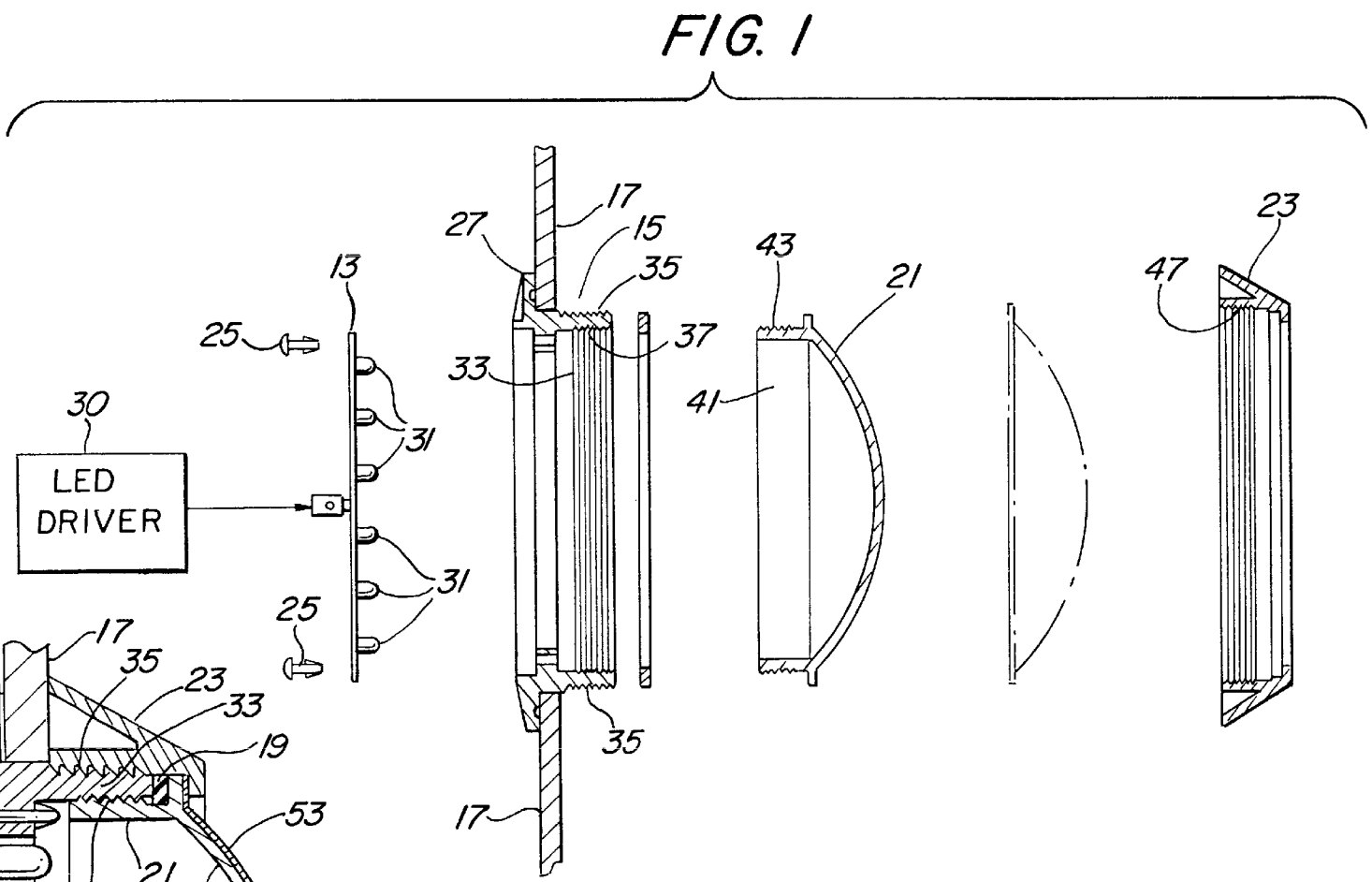
FIG. 1 is an exploded cross sectional view of a spa lighting apparatus according to a first embodiment of the invention.

An embodiment of spa lighting apparatus according to the invention is illustrated in FIG. 1. The embodiment includes an LED (light emitting diode) array 13, a wall fitting 15, a gasket 19, a lens 21, and a bezel 23. The wall fitting 15 is generally circular in cross section and has an angular rear flange 27 which abuts a circular opening in a wall portion 17 of a spa shell. The LED array 13 includes a circular circuit board 29, which mounts a number of LED's 31. The LED array 13 mounts into a rear opening 30 in the wall fitting 15 and is fastened to the wall fitting 15 by screws 25. The screws 25 permit the board 13 to be readily removed rearwardly from the side of the wall 17 of the spa outside of the water for servicing.

A front cylindrical segment 33 of the wall fitting 15 extends into the interior of the spa shell and has a threaded outer surface 35 and a threaded inner surface 37. The lens 21 has a rear cylindrical segment 41 with an outer threaded surface 43. The outer threaded surface 43 of the segment 41 is designed to mate with the inner threaded surface 37 of the wall fitting 15 such that the lens 21 may be screwed into the wall fitting 15.

A bezel 23 has an inner threaded cylindrical segment 47 which mates with the outer threaded surface 35 of the wall fitting 15 such that the bezel 23 may be screwed onto the wall fitting 15 after the lens 21 has been screwed into the wall fitting 15. The bezel prefer ably provides a horizontal force assisting to retain the assembly in place.

The lens 21 is preferably shaped with a domed or bubble contour to provide dispersion of the light from the LED light sources 31 so as to promote the appearance of a single light or lamp. The curvature of the lens 21 determines the angle of the light dispersion. The more severe the curvature, the larger the angle of light dispersion. This allows for a smaller light lens diameter while producing an equal to or greater light dispersion The lens 21 is further provided with a gasket seat area 49 where the gasket 19 is positioned prior to screwing-in the lens 21 and the bezel 23. The gasket 19 serves to provide a water-tight seal, preventing water from leaking into the rear opening 30 of the wall fittings 15. As may be appreciated the construction according to FIG. 1 permits relatively easy replacement of the lens 21.

The lens 21 is preferably provided with a textured interior surfacing 51 and an over-molded layer 53. The lens 21 may be clear polycarbonate such as G.E. LEXAN® to provide impact strength, while the over-molded layer 53 may be an acrylic material which provides a "frosted" appearance.

Figure 12:
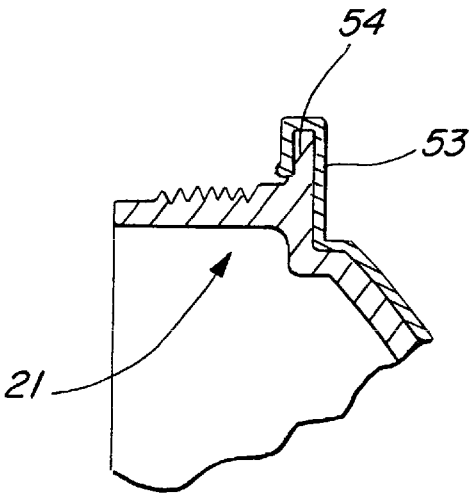
FIG. 12 an enlarged view of a portion of a lens component of the preferred embodiment.

The overmolded layer 53 may wrap around the rim 54 of the lens 21 as shown on FIG. 12. The interior surface may be textured in various configurations, such as Mold Tech 11050, to provide a refractive surface to help bend/scramble the light rays emanating from the multiple light sources 31 contained on the LED array 13. The acrylic material provides chemical resistance while the "frosted" properties of the overmolding material provide additional light refraction to the LED array 13. Approximately 84% or better light transmission may be achieved.

Figure 2:
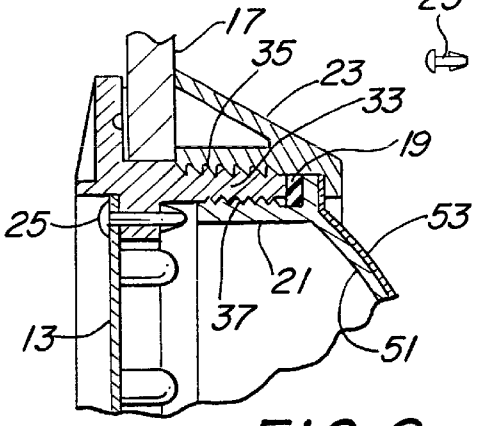
FIG. 2 is a fragmentary cross section of a portion of the embodiment of FIG. 2.

A preferred embodiment light/lens assembly is illustrated in FIGS. 3–12. This assembly is generally similar to the embodiment shown in FIGS. 1–2 with some improvements. In particular, the embodiment of FIGS. 3–12 includes an adapter ring 61 shown in detail in FIGS. 8 to 10. The adapter ring 61 permits installing the light/lens assembly of the preferred embodiment into larger holes which previously accommodated prior art light fixtures. Thus, the adapter ring 61 is used in retrofitting older spas with improved apparatus provided according to the invention. In such applications, the ring 61 is glued to the spa wall surface.

Figure 6:
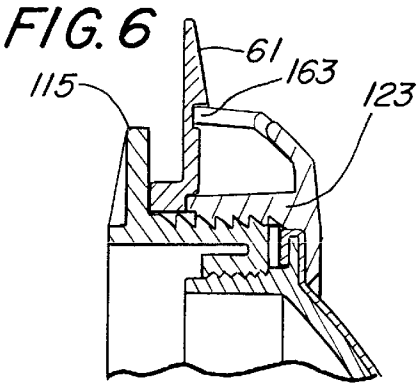
FIG. 6 is a blown-up fragment of the embodiment of FIG. 3.
Figure 5:
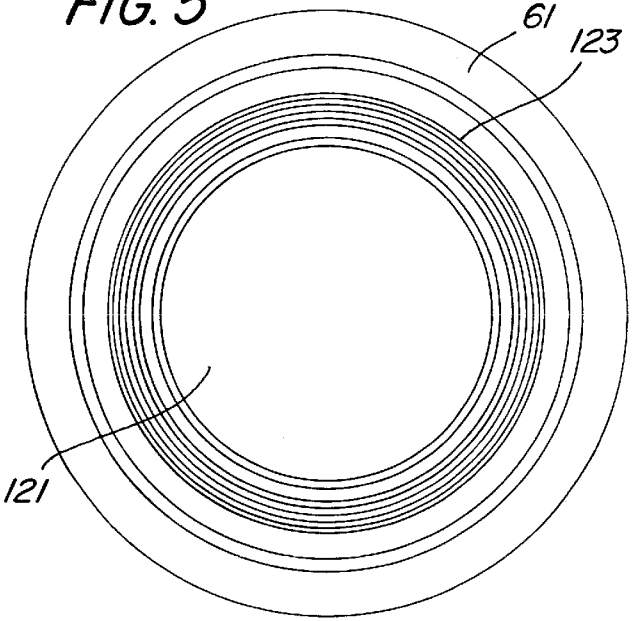
FIG. 5 is a front view of the embodiment of FIG. 3.
Figure 3:
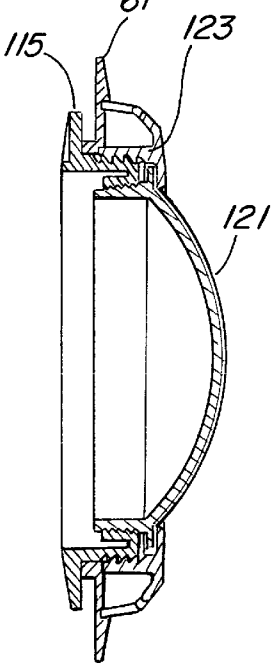
FIG. 3 is a side view of a preferred embodiment of the invention.
Figure 4:
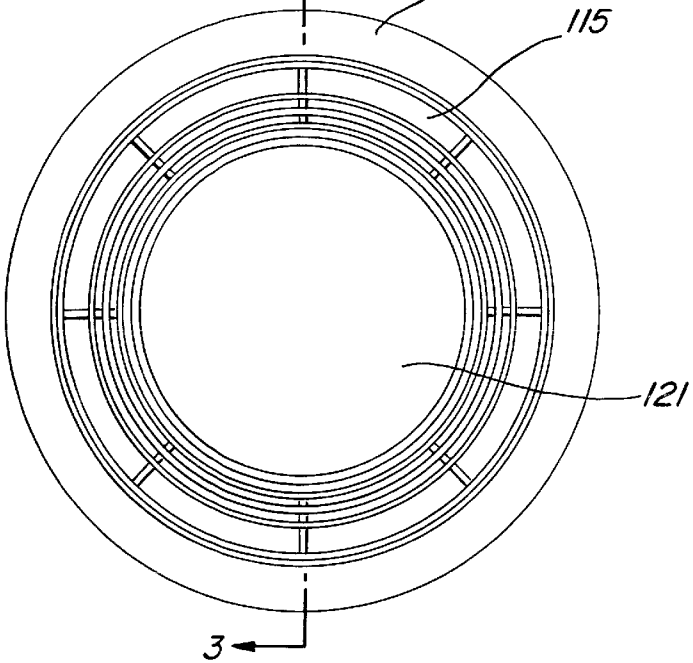
FIG. 4 is a back view of the embodiment of FIG. 3.
Figure 9:
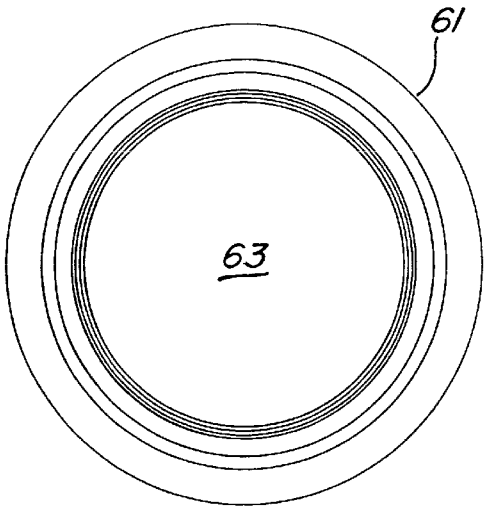
FIG. 9 is a front view of the adapter ring component.
Figure 10:
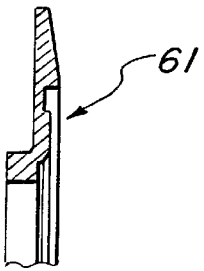
FIG. 10 is an enlarged view of a portion of FIG. 7
Figure 7:
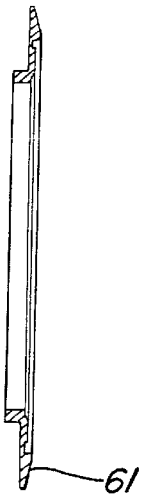
FIG. 7 is a sectional view of an adapter ring component taken at 7—7 of FIG. 8.
Figure 8:
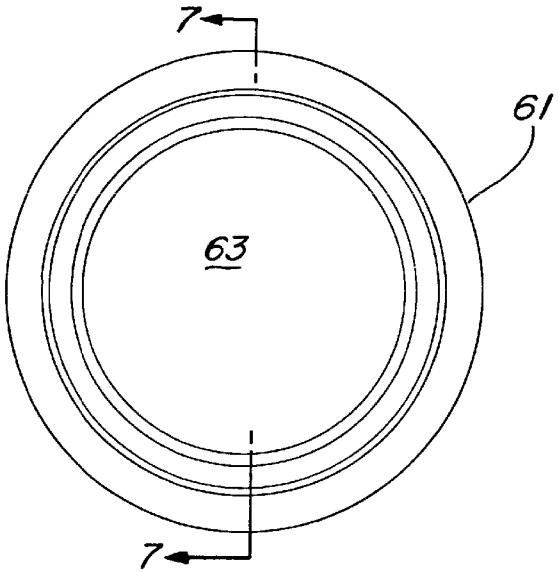
FIG. 8 is a rear view of an adapter ring component.

The adapter ring 61 has a central circular opening 63 sized to fit over the hub 133 of the wall fitting 115. The back surface 163 of the bezel component 123 abuts an outer ring surface 165 of the adapter ring 61, as shown in FIG. 6, and presses the surface 165 into the spa wall 17 when the assembly is installed.

Figure 11:
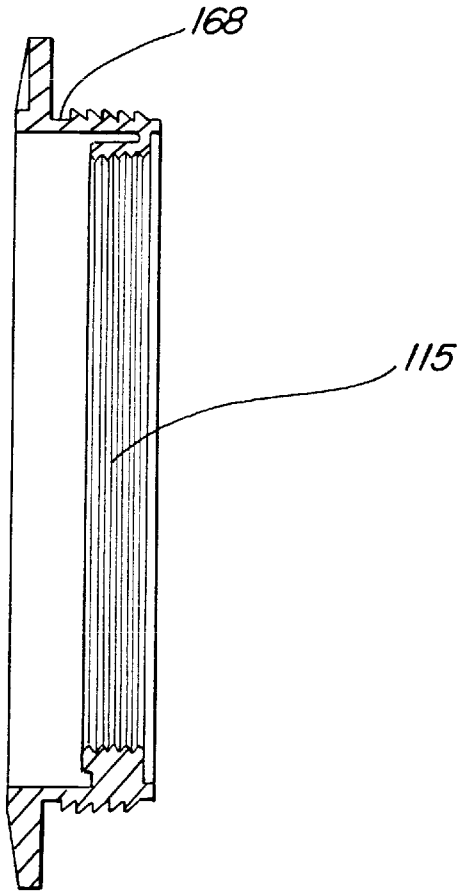
FIG. 11 is a cross sectional view of a wall fitting according to the preferred embodiment.

As particularly seen in FIG. 11, the wall fitting 115 has a depression 168 formed at a back edge thereof, which provides a glue well, which is employed in gluing the wall fitting 115 to the spa wall when the wall fitting 115 is initially installed. Thus, both gluing and bezel pressure are used to hold the assembly in place with respect to the spa wall 17.

The LED array 13 may employ 12 LED's each powered at 12 volts D.C. to provide, for example, an 85 watt light output. One may overdrive the LED's with a pulse width modulated voltage source 32 (FIG. 1) to "squeeze out" greater brightness, while avoiding flicker. Various color LED's such as red or blue or a combination of colors may be used. Thin film color filters may also be employed. The overmolding can also be colored.

According to the preferred embodiment, LED's are employed in such a manner as to give the appearance of a single incandescent source, while taking advantage of the long life (100,000 hours) and low power of the LED devices. A reduced size lens may also be employed and is mounted in a structure which relieves the forces to which the lens is subjected thereby contributing to longer lens life. Incandescent lamps such as an 80 watt bulb also may be used in alternate embodiments. The particular lens component disclosed provides adequate optical characteristics for either incandescent or LED sources.

While the embodiment above illustrates a rear-mounted LED panel, other embodiments-can be configured with front mounted LED arrays to provide even greater ease of installation and repair.

From the above description, those skilled in the art will appreciate that various adaptations and modifications of the just-described preferred embodiments can be configured without departing from the scope and spirit of the invention. Therefore, it is to be understood that within the scope of the appended claims, the invention may be practiced other than as specifically described herein.

What is claimed is:

1. Spa lighting apparatus comprising:

a wall fitting having a cylindrical segment sized to fit in a circular opening in a spa wall, the cylindrical segment having a threaded outer surface and a threaded inner surface;

a light lens having a curved light transmissive surface and a rear cylindrical segment, said rear cylindrical segment having a threaded outer surface for engaging the threaded inner surface of the cylindrical segment of said wall fitting; and a plurality of light emitting diodes (LED's) mounted within said wall fitting whereby the plurality of LED's appear as a single light source through the light lens.

2. The apparatus of claim 1 further comprising a bezel having a cylindrical segment with an inner threaded surface for engaging the threaded outer surface of the cylindrical segment of said wall fitting.

3. The apparatus of claim 2 wherein said lens comprises:

a first plastic layer providing impact strength; and a second layer overmolded on said first layer to provide chemical resistance.

4. The apparatus of claim 3 wherein said first plastic layer is a polycarbonate layer and said second layer comprises an acrylic material.

5. The apparatus of claim 4 further including a textured inner surface on said lens.

6. The apparatus of claim 1 wherein said LED's are mounted on a panel sized to fit within said wall fitting.

7. The apparatus of claim 4 wherein said LED's are mounted on a panel sized to fit within said wall fitting.

8. The apparatus of claim 7 wherein the number of LED's on said panel is twelve.

9. An apparatus comprising:

a portable spa wall having an opening therein;

a wall fitting having a cylindrical segment with a threaded outer surface and a threaded inner surface mounted to the spa wall by passing the cylindrical segment through the opening, the wall fitting having a glue well formed about the periphery thereof, said glue well mating with said spa wall;

a light lens having a curved light transmissive surface and a rear cylindrical segment, said rear cylindrical segment having a threadable outer surface for engaging the threaded inner surface of the cylindrical segment of said wall fitting; and a plurality of light emitting diodes (LED's) mounted within said wall fitting whereby the plurality of LED's appear as a single light source through the light lens.

10. The apparatus of claim 9 further comprising a bezel having a cylindrical segment with an inner threaded surface for engaging the threaded outer surface of the cylindrical segment of said wall fitting.

11. The apparatus of claim 9 wherein said lens comprises:

a first plastic layer providing impact strength; and a second layer overmolded on said first layer to provide chemical resistance.

12. The apparatus of claim 11 wherein said first plastic layer is a polycarbonate layer and said second layer comprises an acrylic material.

13. The apparatus of claim 12 further including a textured inner surface on said lens.

14. The apparatus of claim 9 wherein said LED's are mounted on a panel sized to fit within said wall fitting.

15. The apparatus of claim 13 wherein said LED's are mounted on a panel sized to fit within said wall fitting.

16. An apparatus comprising:

a wall fitting having a recess therein adapted to fit into an aperture in a wall of a portable spa;

a circuit board having a plurality of LED's mounted thereon, the circuit board sized to fit into the recess of the wall fitting; and a lens adapted for attachment to the wall fitting, the lens including means for dispersing the light from said plurality of LED's creating the appearance of a single light source.

17. The apparatus of claim 1 further comprising a gasket between the light lens and cylindrical segment of the wall fitting to provide a water tight seal when the light lens is threaded into the wall fitting.

18. The apparatus of claim 9 further comprising a gasket between the light lens and cylindrical segment of the wall fitting to provide a water tight seal when the light lens is threaded into the wall fitting.

19. The apparatus of claim 10 further comprising an adapter ring having an opening thereon that fits around the outer surface of the cylindrical segment of the wall fitting and is held against the spa wall by the bezel when threaded into the wall fitting.

* * * * *